US011390086B2

(12) United States Patent
Ochiai

(10) Patent No.: US 11,390,086 B2
(45) Date of Patent: Jul. 19, 2022

(54) LIQUID EJECTING APPARATUS

(71) Applicant: SEIKO EPSON CORPORATION, Tokyo (JP)

(72) Inventor: Toshiyuki Ochiai, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/192,693

(22) Filed: Mar. 4, 2021

(65) Prior Publication Data

US 2021/0276336 A1 Sep. 9, 2021

(30) Foreign Application Priority Data

Mar. 5, 2020 (JP) ..... JP2020-037835

(51) Int. Cl.
*B41J 2/17* (2006.01)
*B41J 2/185* (2006.01)
*B41J 2/165* (2006.01)

(52) U.S. Cl.
CPC ..... *B41J 2/1721* (2013.01); *B41J 2/16523* (2013.01); *B41J 2/185* (2013.01)

(58) Field of Classification Search
CPC ..... B41J 2/1721; B41J 2/16523; B41J 2/185
See application file for complete search history.

(56) References Cited

U.S. PATENT DOCUMENTS

2016/0207335 A1* 7/2016 Kobayashi ..... B41J 2/175

FOREIGN PATENT DOCUMENTS

JP 2017113892 A * 6/2017 ..... B41J 2/17509
JP 2018-187888 A 11/2018

* cited by examiner

*Primary Examiner* — Sharon Polk
(74) *Attorney, Agent, or Firm* — Oliff PLC

(57) ABSTRACT

A liquid ejecting apparatus has a housing constituting the exterior and includes: a liquid ejecting head; a liquid container; a maintenance device; a waste liquid container; a supply tube; a waste liquid tube; and a guide along which the supply tube and the waste liquid tube are routed in parallel. Assuming that one side of the housing is a rear side and another side facing the one side is a front side in plan view, the maintenance device is disposed closer to a rear side than the liquid container is, the liquid ejecting head is disposed at a side of the maintenance device so as to be movable in the left-right direction, and the guide is disposed in an area between the maintenance device and the front side of the liquid container.

5 Claims, 9 Drawing Sheets

LIQUID EJECTING APPARATUS

The present application is based on, and claims priority from JP Application Serial Number 2020-037835, filed Mar. 5, 2020, the disclosure of which is hereby incorporated by reference herein in its entirety.

BACKGROUND

1. Technical Field

The present disclosure relates to a liquid ejecting apparatus.

2. Related Art

JP-A-2018-187888 discloses a liquid ejecting apparatus including: a liquid ejecting head; a liquid container; a maintenance device; a waste liquid container; a supply flow path to which the liquid ejecting head and the liquid container are coupled; and a waste liquid flow path to which the maintenance device and the waste liquid container are coupled.

However, because the supply flow path and the waste liquid flow path are separately routed, the routing structure is complex, increasing the size of the liquid ejecting apparatus.

SUMMARY

The present disclosure provides a liquid ejecting apparatus having a housing constituting an exterior and including: a liquid ejecting head that ejects liquid; a liquid container that stores the liquid to be supplied to the liquid ejecting head; a maintenance device that performs maintenance of the liquid ejecting head; a waste liquid container that stores the liquid discharged in the maintenance device from the liquid ejecting head as waste liquid; a supply tube coupling the liquid container and the liquid ejecting head; a waste liquid tube coupling the maintenance device and the waste liquid container; and a guide along which the supply tube and the waste liquid tube are routed in parallel. Assuming that one side of the housing is a rear side and another side facing the one side is a front side in plan view, the maintenance device is disposed closer to a rear side than the liquid container is, the liquid ejecting head is disposed at a side of the maintenance device so as to be movable in the left-right direction, which intersects the front-rear direction in which the rear side and the front side face each other, the waste liquid container is disposed closer to a front side than the liquid ejecting head is and at a side of the liquid container, and the guide is disposed in an area between the maintenance device and the front side of the liquid container.

DESCRIPTION OF EXEMPLARY EMBODIMENTS

First, a schematic structure of a liquid ejecting apparatus 1 will be described.

Figure 1:
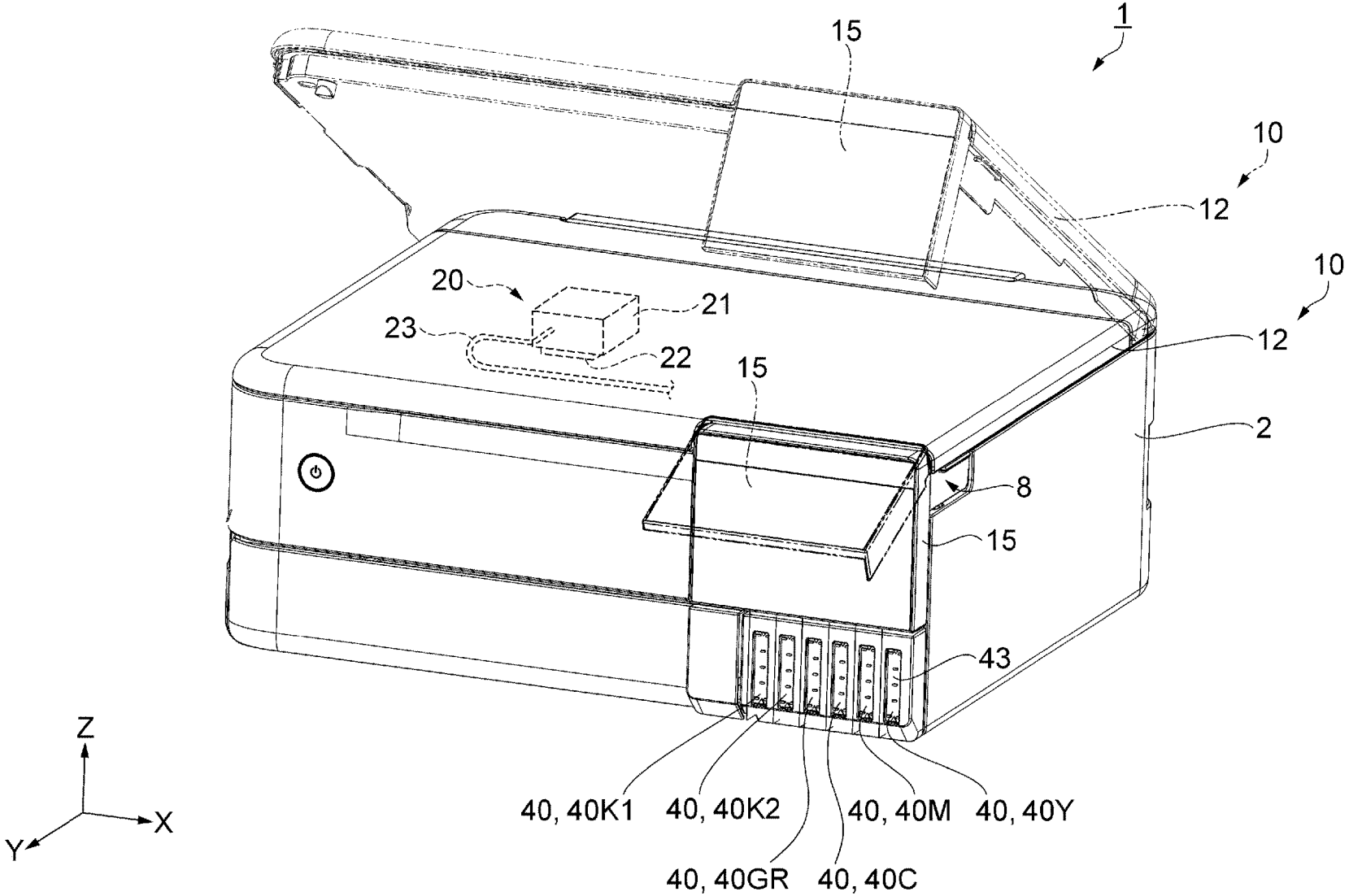
FIG. 1 is a perspective view showing the structure of a liquid ejecting apparatus.
Figure 2:
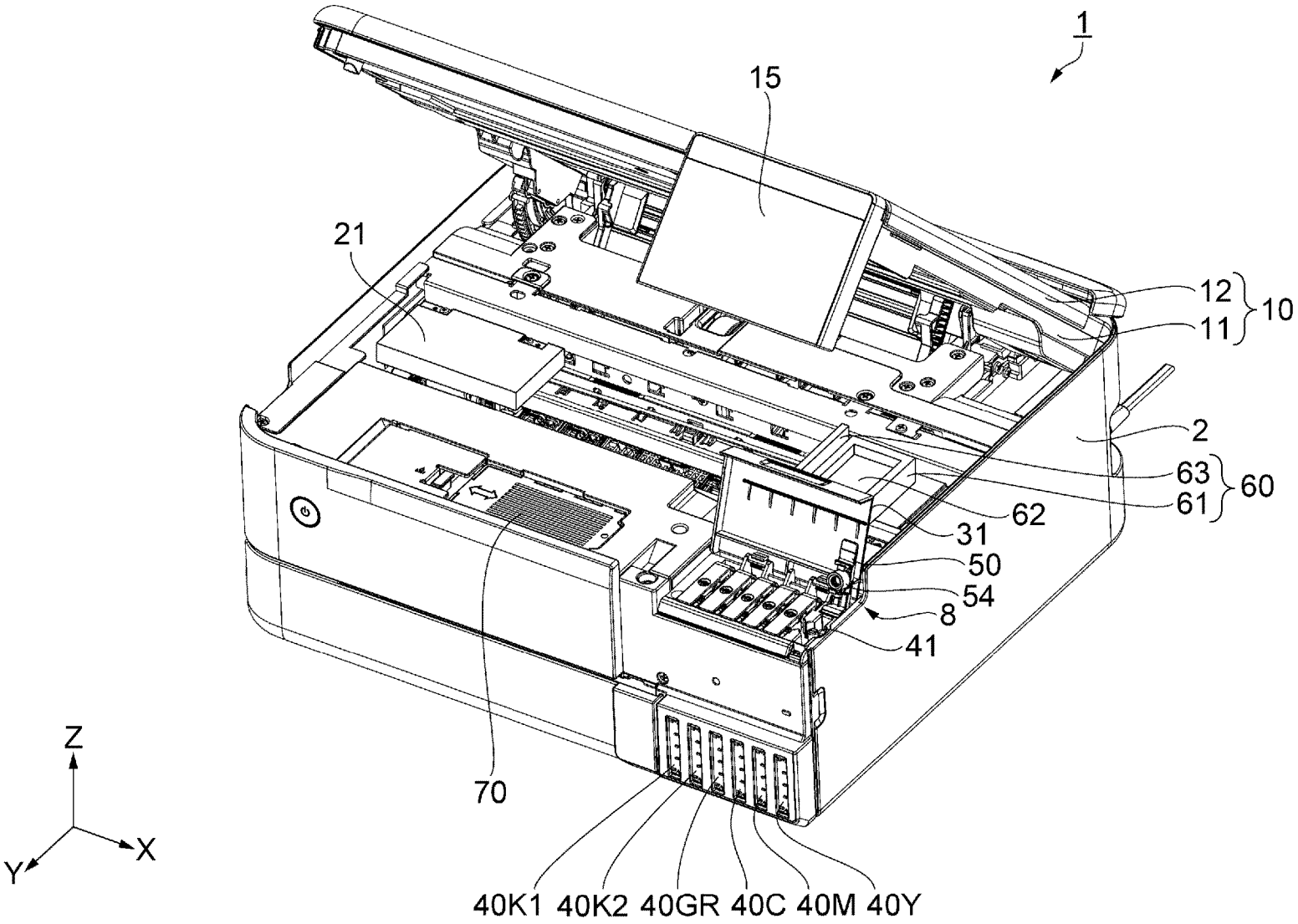
FIG. 2 is a perspective view showing the structure of the liquid ejecting apparatus.
Figure 3:
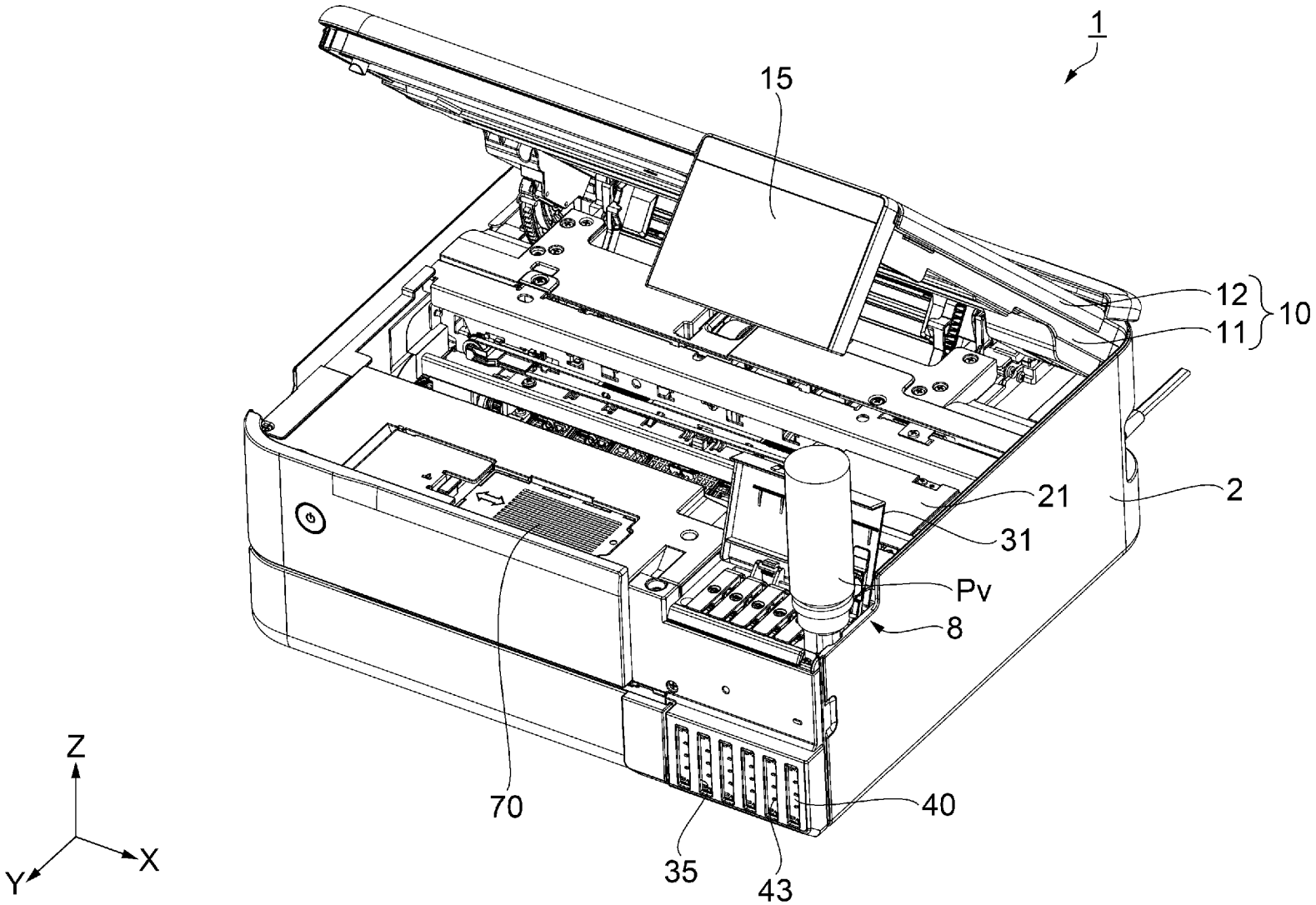
FIG. 3 is a perspective view showing the structure of the liquid ejecting apparatus.

FIGS. 1 to 3 are perspective views showing the structure of the liquid ejecting apparatus 1. More specifically, FIG. 1 shows a state in which a scanner 10 is closed with respect to a housing 2, which constitutes the exterior of the liquid ejecting apparatus 1. FIGS. 2 and 3 show a state in which the scanner 10 is opened with respect to the housing 2.

As shown in FIGS. 1 to 3, the liquid ejecting apparatus 1 includes: the housing 2 having a rectangular-parallelepiped shape; and the scanner 10 attached to the top of the housing 2, and is disposed on a horizontal surface.

The longitudinal direction (left-right direction) of the rectangular-parallelepiped-shaped housing 2 is parallel to the X axis, the transverse direction (front-rear direction) of the housing 2 is parallel to the Y axis, and the height direction (top-bottom direction) of the housing 2 is parallel to the Z axis. The directions toward the heads of the direction-indicating arrows are positive (+) directions, and the directions toward the tails of the arrows are negative (−) directions. The plane parallel to the X-axis direction and the Y-axis direction (XY plane) is a horizontal plane, and the −Z direction is the gravity direction.

The scanner 10 is provided on and is attached to the top of the housing 2 so as to be pivotable relative to the housing 2. The scanner 10 includes a scanner housing 11, on which an original document is placed to be read, and a document cover 12 disposed thereon.

The document cover 12 protects the scanner housing 11 and is pivotable relative to the scanner housing 11. Furthermore, a display 15 is attached to the +Y side end of the document cover 12.

The display 15 can pivot with the document cover 12 relative to the scanner housing 11 and can be tilted relative to the document cover 12. In short, the display 15 is attached to an end of the scanner 10, can pivot with the scanner 10, and can be tilted.

The display 15 is formed of a liquid-crystal-display module having a touch panel function. The display 15 has a mechanism for guiding the operation of the liquid ejecting apparatus 1 (display function) and a function for allowing a user to perform various settings to the liquid ejecting apparatus 1. A user can perform various operations with the liquid ejecting apparatus 1 while viewing images displayed on the display 15 tilted to an easily viewable position. A user can also perform various settings to the liquid ejecting apparatus 1 through the display 15 tilted to a position where he/she can easily touch.

Furthermore, by pivoting the display 15 with the scanner 10 and opening the scanner 10, to which the display 15 is attached, with respect to the housing 2, liquids can be poured to liquid containers 40 from refill containers Pv, which store the liquids (see FIG. 3). The liquid containers 40 store the liquids to be supplied to the liquid ejecting head 22. There are six liquid containers 40 in this embodiment. The six liquid containers 40 include a liquid container and another liquid container. When there is no need to distinguish between the liquid container and the other liquid container, they are simply called the liquid containers 40.

The liquid containers 40 have pouring ports 41 from which the liquids can be poured from the refill containers Pv. The liquid containers 40 have pivotable levers 50 having lids 54 for sealing (tightly closing) the pouring ports 41. A cover 31 is provided on the levers 50. The cover 31 can be opened and closed. When the cover 31 is opened, the liquid containers 40 are exposed and can be refilled with the liquids from the refill containers Pv. When the cover 31 is closed, the liquid containers 40 are protected by the cover 31. When the cover 31 is closed, the cover 31 is parallel to the XY plane (horizontal plane).

The six liquid containers 40 include: a liquid container 40K1, which stores a black liquid containing black pigment as colorant; a liquid container 40K2, which stores a black liquid containing black dye as colorant; a liquid container 40GR, which stores a gray liquid containing gray dye as colorant; a liquid container 40C, which stores a cyan liquid containing cyan pigment as colorant; a liquid container 40M, which stores a magenta liquid containing magenta pigment as colorant; and a liquid container 40Y, which stores a yellow liquid containing yellow pigment as colorant.

The liquid container 40K1, the liquid container 40K2, the liquid container 40GR, the liquid container 40C, the liquid container 40M, and the liquid container 40Y are arranged in this order toward the +X side.

The number of the liquid containers 40 is not limited to six but is at least two. The colorant contained in the liquids stored in the liquid containers 40 may be either pigment or dye. Furthermore, the liquid containers 40 may store liquids that do not contain colorant.

The liquid containers 40 have view surfaces 43 on the +Y side. The view surfaces 43 have marks indicating whether the liquid containers are empty or full.

The liquid containers 40 are made of a semi-transparent or transparent material, so that the liquids stored in the liquid containers 40 can be viewed from outside. The view surfaces 43 are provided so as to correspond to openings 35 provided in the housing 2, and a user grasps the states of the liquids stored in the liquid containers 40 through the view surfaces 43.

The housing 2 has a cut-away portion 8 in the side surface on the +X side. The length of the cut-away portion 8 in the Y-axis direction is substantially the same as the length of the cover 31 in the Y-axis direction. The cut-away portion 8 is formed to have substantially the same height in the Z direction as the cover 31 in a closed state. The cut-away portion 8 provides a space for inserting the refill container Pv when refilling the liquid container 40Y, which is located on the extreme +X side.

A recording unit 20 is disposed inside the housing 2. The recording unit 20 can record an image on a medium (not shown) using the liquids. The recording unit 20 includes a carriage 21, a liquid ejecting head 22 that is attached to the carriage 21 and ejects the liquids toward the medium, and supply tubes 23 through which the liquids are supplied from the liquid containers 40 to the liquid ejecting head 22 (see FIG. 1). In this embodiment, the supply tubes 23 are coupled to the six liquid containers 40. More specifically, a supply tube 23K1 is coupled to the liquid container 40K1, a supply tube 23K2 is coupled to the liquid container 40K2, a supply tube 23GR is coupled to the liquid container 40GR, a supply tube 23C is coupled to the liquid container 40C, a supply tube 23M is coupled to the liquid container 40M, and a supply tube 23Y is coupled to the liquid container 40Y (see FIG. 8). The six supply tubes 23 include a supply tube and another supply tube. When there is no need to distinguish between the supply tube and the other supply tube, they are simply called the supply tubes 23.

The carriage 21 is supported by a guide shaft (not shown) and is movable in the X-axis direction, which intersects the transport direction (Y-axis direction) in which the medium is transported.

The liquid ejecting head 22 can move with the carriage 21 in the X-axis direction. The liquid ejecting head 22 includes, for example, pressure generating chambers, nozzles communicating with the pressure generating chambers, and piezoelectric elements that can change the capacity of the pressure generating chambers, and, by changing the capacity of the pressure generating chambers, the liquid can be discharged from the nozzles.

The liquid ejecting apparatus 1 according to this embodiment records a desired image on a medium by alternately repeating an operation in which the liquid ejecting head 22 ejects the liquids onto a medium while reciprocating in the X-axis direction and an operation in which the medium is transported in the transport direction.

The liquid ejecting apparatus 1 further includes a maintenance device 60. The maintenance device 60 is provided closer to the +X side than the area, in the X-axis direction, in which the medium is transported. The maintenance device 60 performs various maintenance on the liquid ejecting head 22. The maintenance device 60 includes a cap unit 61. The cap unit 61 includes a cap 62 having a recess. The cap unit 61 has a lifting/lowering mechanism including a driving motor (not shown) so as to be able to move the cap 62 in the Z-axis direction. When the liquid ejecting apparatus 1 is not operating, the cap 62 is brought into tight contact with the liquid ejecting head 22 so as to cap the area having the nozzles. This prevents the inconvenience, such as clogging of nozzles with dried liquids.

The maintenance device 60 has a function of cleaning the nozzles. More specifically, for example, when the liquids have not been ejected from the nozzles for a long time or when foreign matter, such as paper dust, is attached to the nozzles, the nozzles may be clogged. If the nozzles are clogged, the liquids are not ejected when the liquids should be ejected from the nozzles, leading to a phenomenon called "missing nozzle", in which droplet dots are not formed on an area of a medium where the droplet dots should be formed. The missing nozzle degrades the image quality. To prevent this problem, the liquids are forcedly discharged from the nozzles toward the recess in the cap 62 (flushing). By doing the flushing, the nozzles are cleaned, improving the discharge condition of the nozzles. The waste liquid discharged in the cap 62 is collected in the waste liquid container 70.

The maintenance device 60 also includes a suction pump that sucks the liquids inside the liquid ejecting head 22 in a state in which the liquid ejecting head 22 is capped with the cap unit 61 and discharges the sucked liquid as waste liquid. By forcedly causing the liquids to be discharged from the inside of the liquid ejecting head 22, it is possible to recover the nozzles that have become unable to eject the liquids due to thickening of the liquids, destruction of meniscus, and clogging of the nozzles with paper dust, and to prevent thickening of the liquids in the nozzles. The waste liquid forcedly discharged from the liquid ejecting head 22 is collected in the waste liquid container 70.

The maintenance device 60 also includes a plate-shaped wiper 63 that wipes a nozzle surface of the liquid ejecting head 22. By wiping the nozzle surface of the liquid ejecting head 22 after various maintenance, the liquid, etc., can be removed from the nozzle surface.

Next, the layout of the components in the housing 2 will be described.

Figure 4:
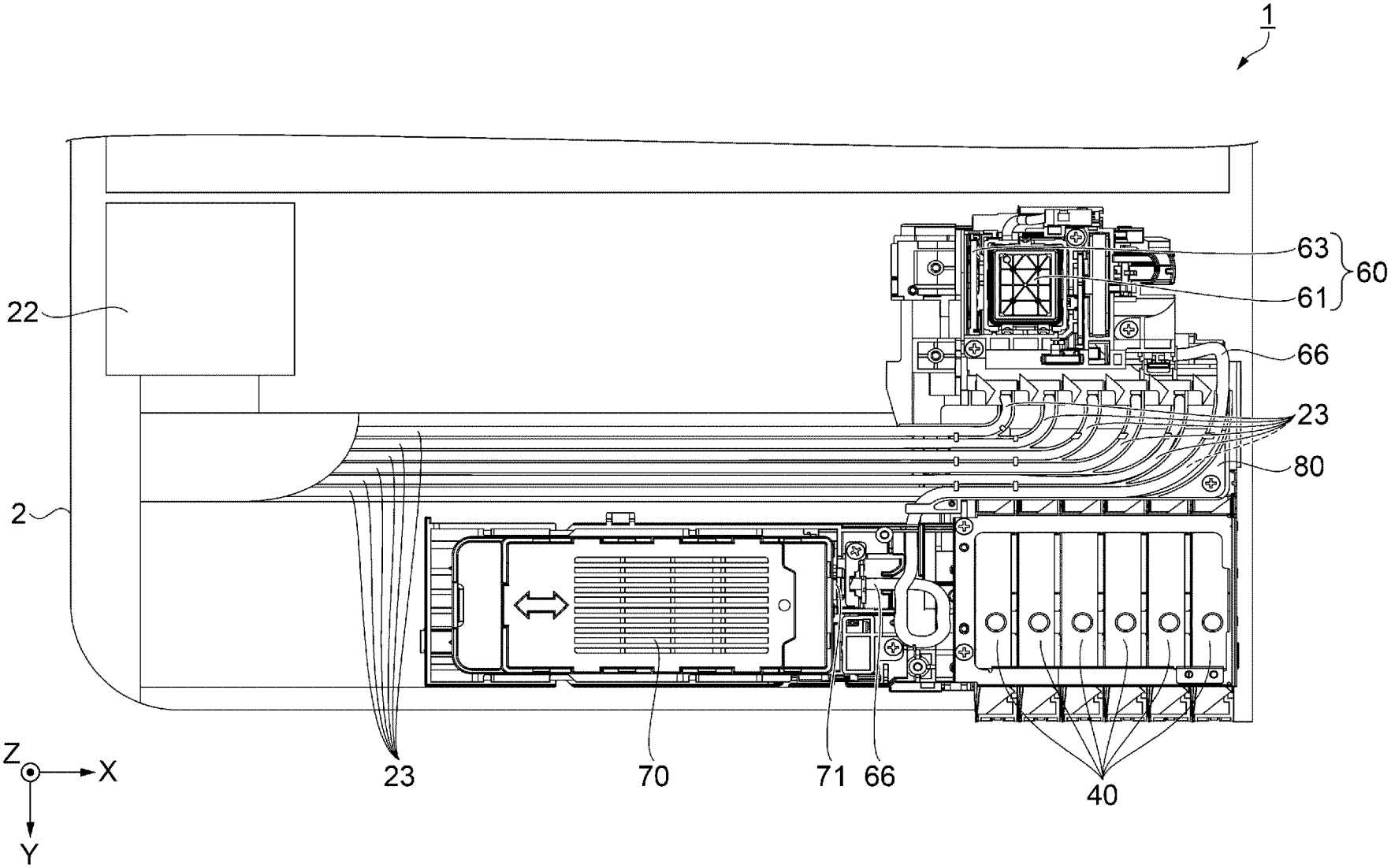
FIG. 4 is a plan view showing the structure of the liquid ejecting apparatus.

As shown in FIG. 4, in plan view, assuming that one side of the housing 2 is a rear side (−Y side), and the other side facing the one side is a front side (+Y side), the maintenance device 60 is disposed closer to the rear side (+Y side) than the liquid containers 40 are. The liquid ejecting head 22 is disposed at the side of the maintenance device 60 so as to be movable in the left-right direction (X-axis direction), which intersects the front-rear direction (Y-axis direction) in which the rear side and the front side face each other. The waste liquid container 70 is disposed closer to the front side (+Y side) than the liquid ejecting head 22 is and is disposed at the side of the liquid containers 40.

A guide 80 is disposed in the area between the maintenance device 60 and the front side (+Y side) of the liquid containers 40.

In other words, in this embodiment, in plan view, the maintenance device 60, the liquid containers 40, and the guide 80 are disposed on the +X side in the housing 2. The guide 80 and the liquid containers 40 are disposed to the +Y side of the maintenance device 60. The liquid ejecting head 22 is disposed at a side of the maintenance device 60 so as to be movable in the X-axis direction. The waste liquid container 70 is disposed to the −X side of the liquid containers 40.

The liquid containers 40 and the liquid ejecting head 22 are coupled to each other by the supply tubes 23. In this embodiment, the supply tubes 23 are coupled to the liquid containers 40. Hence, six supply tubes 23 are routed between the liquid containers 40 and the liquid ejecting head 22. More specifically, the supply tubes 23 are routed from the +X side, on which the liquid containers 40 are disposed in the housing 2, toward the −X side.

The cap unit 61 of the maintenance device 60 and the waste liquid container 70 are coupled to each other by a waste liquid tube 66. More specifically, the waste liquid tube 66 is routed from the +X side and the −Y side, where the cap unit 61 is disposed in the housing 2, toward the +Y side and is then toward the waste liquid container 70, which is disposed to the −X side of the liquid containers 40. The waste liquid tube 66 is coupled to an introduction member 71 of the waste liquid container 70. With this structure, the waste liquid produced in the maintenance device 60 is collected in the waste liquid container 70 through the waste liquid tube 66.

Figure 5:
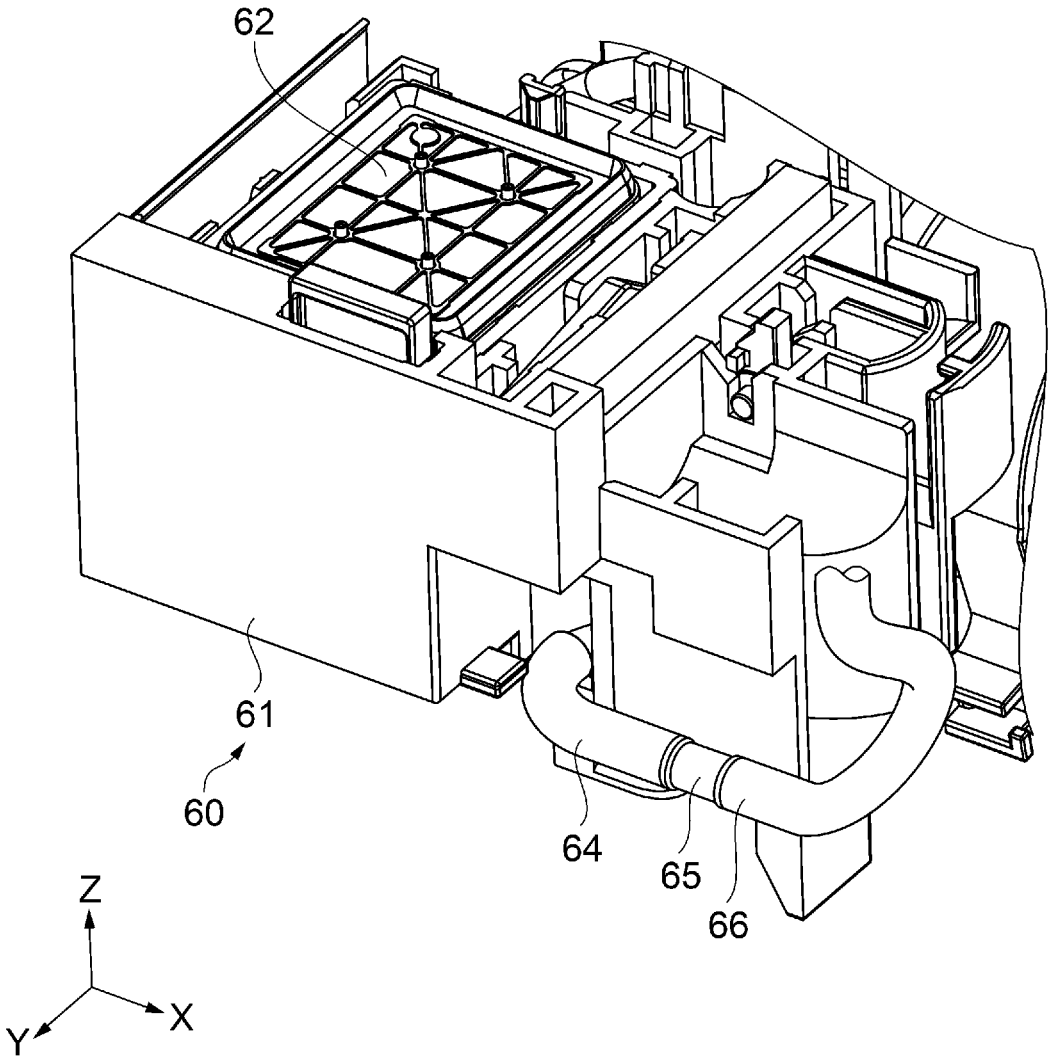
FIG. 5 is a perspective view showing a maintenance device and a waste liquid tube coupled to each other.

Furthermore, as shown in FIG. 5, the cap unit 61 of the maintenance device 60 has a coupling tube 64 through which the liquid received with the cap unit 61 is guided outside, and a joint 65 coupled to the coupling tube 64. The joint 65 is coupled to the waste liquid tube 66. The joint 65 is tube-shaped. The liquid received with the cap unit 61 flows through the joint 65 to the waste liquid tube 66. The waste liquid tube 66 is not directly coupled to the cap unit 61, but the waste liquid tube 66 is coupled to the cap unit 61 via the joint 65 provided on the cap unit 61. This structure makes the maintenance device 60 compact and allows the maintenance device 60 to be used in other models of liquid ejecting apparatuses in which, for example, the length of the waste liquid tube 66 is different.

In the guide 80, the supply tubes 23 and the waste liquid tube 66 are routed in parallel. More specifically, the six supply tubes 23 are routed to the guide 80, and the waste liquid tube 66 is routed so as to be parallel to one of the six supply tubes 23, that is, so as to extend in the same direction as the direction in which the aforementioned supply tube 23 is routed in the guide 80.

With this structure, the supply tubes 23 and the waste liquid tube 66 are not separately routed but are routed as a bundle gathered at the guide 80, located in the middle of the routing paths of the supply tubes 23 and the waste liquid tube 66. This simplifies the routing structure of the supply tubes 23 and the waste liquid tube 66, compared with a structure in which the supply tubes 23 and the waste liquid tube 66 are separately routed. Because the routing structure of the supply tubes 23 and the waste liquid tube 66 is compact, the liquid ejecting apparatus 1 can be made compact.

Next, the structure of the guide 80 and the routing state of the supply tubes 23 and the waste liquid tube 66 routed to the guide 80 will be described.

Figure 6:
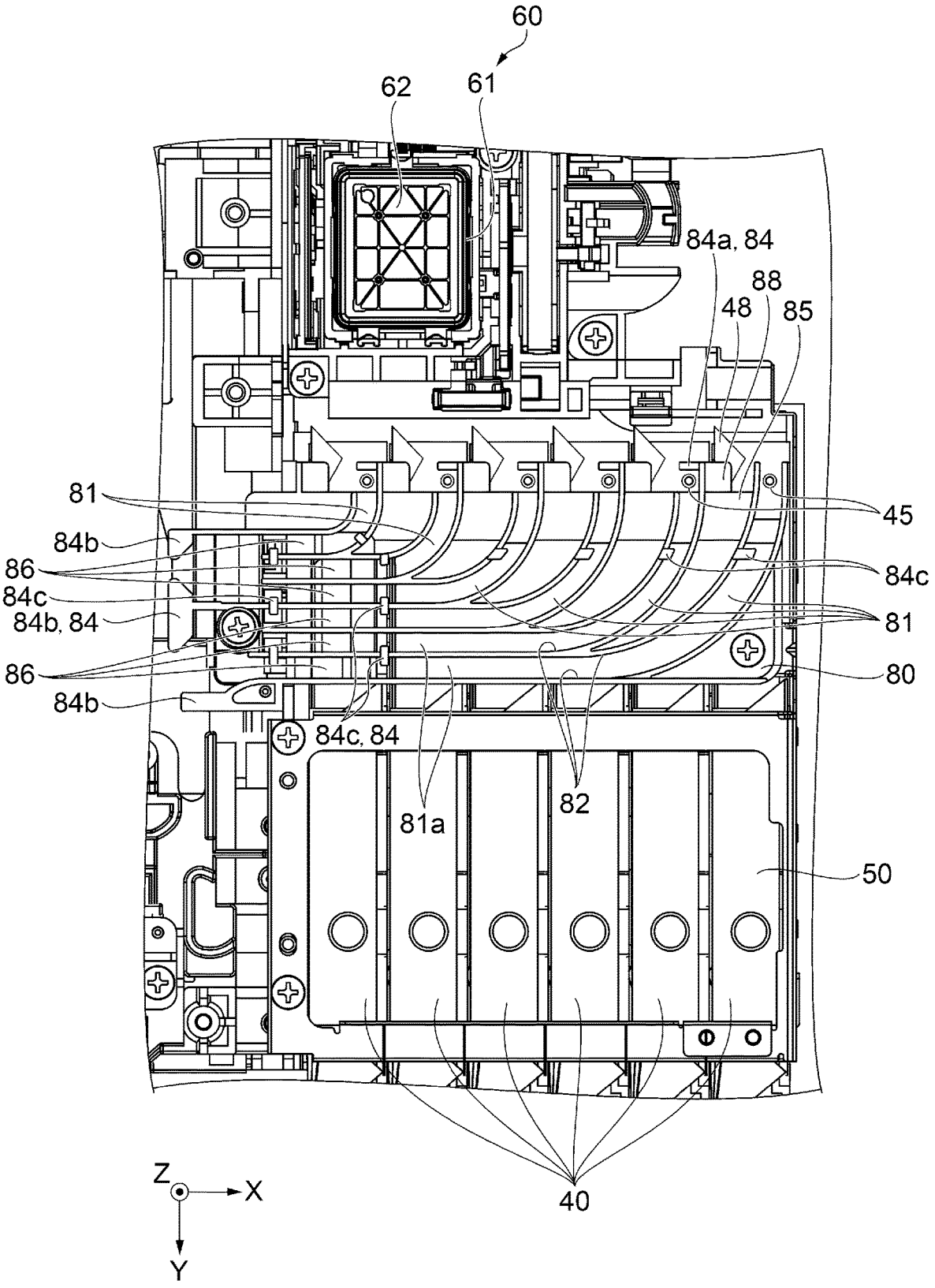
FIG. 6 is a plan view showing the structure of a guide.
Figure 7:
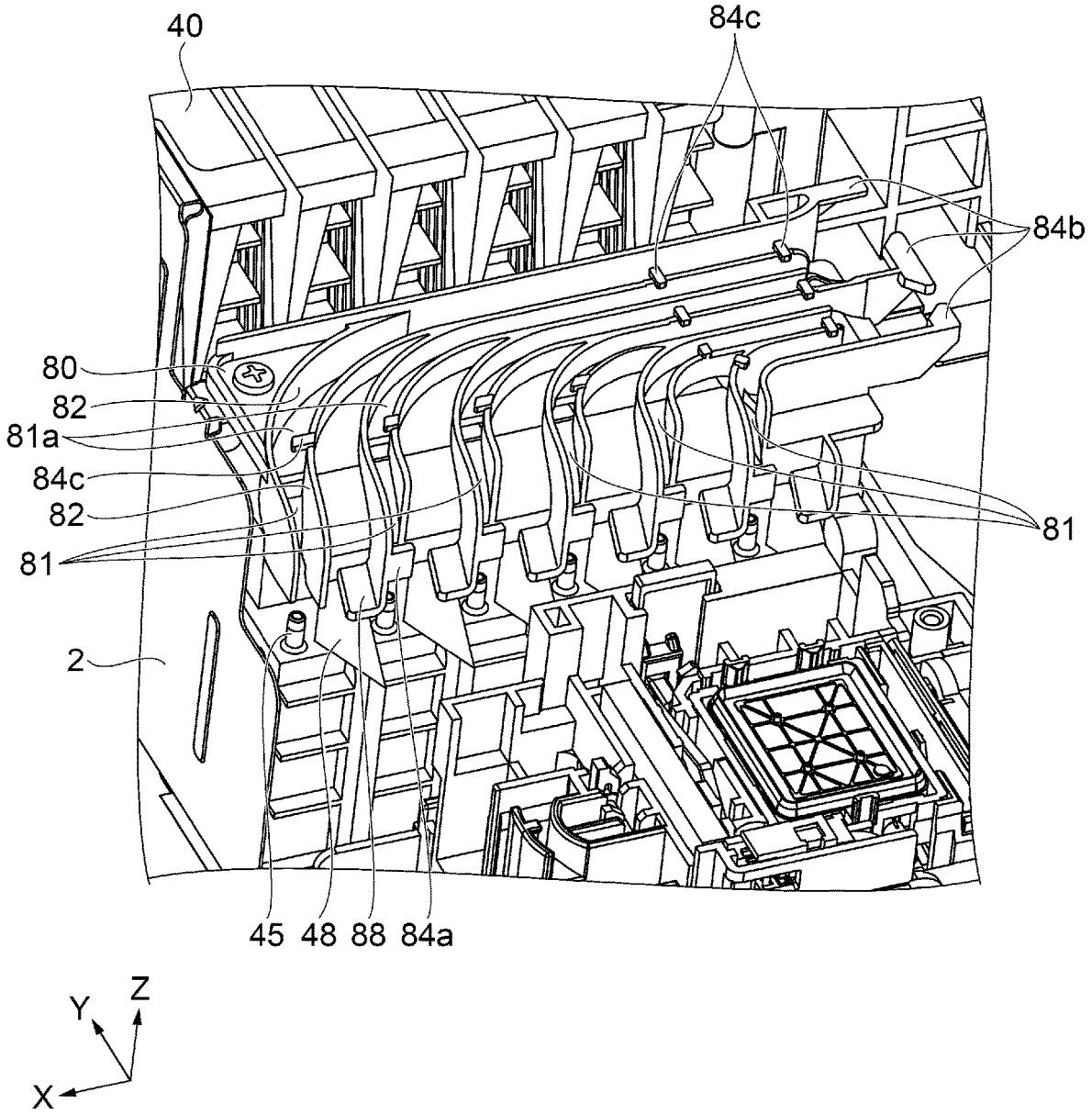
FIG. 7 is a perspective view showing the structure of the guide.
Figure 8:
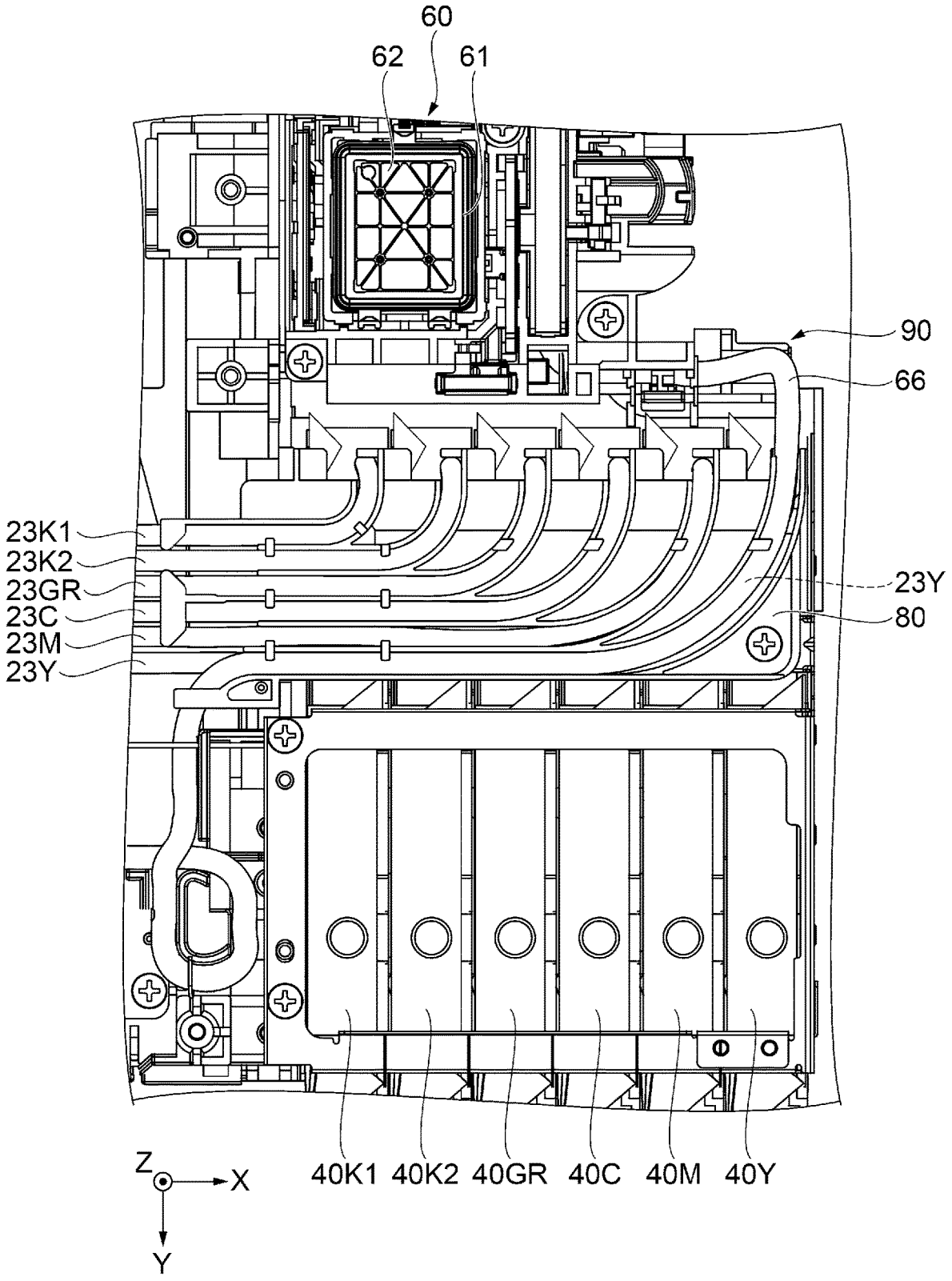
FIG. 8 is a plan view showing routing of supply tubes and the waste liquid tube in the guide.
Figure 9:
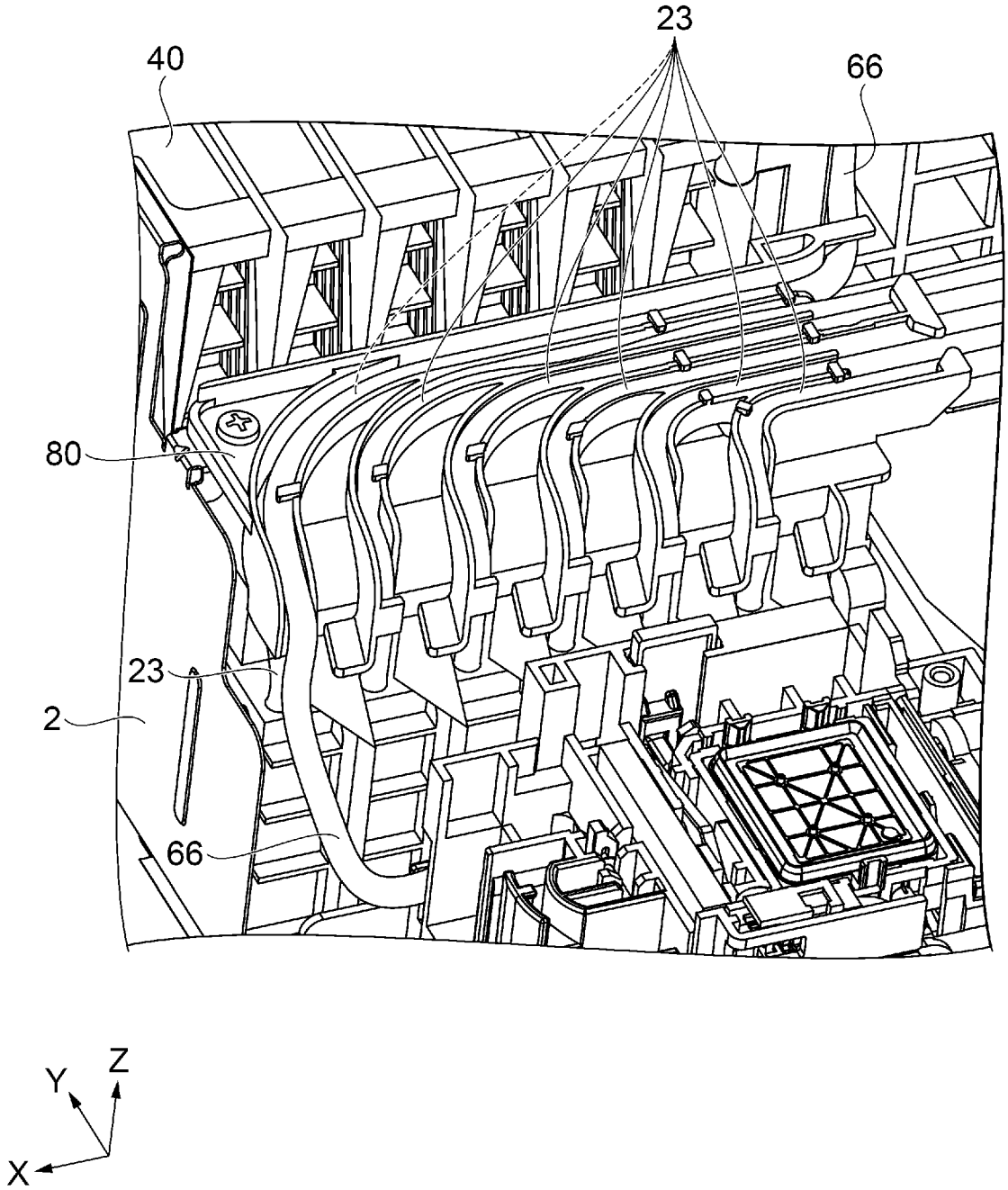
FIG. 9 is a perspective view showing routing of the supply tubes and the waste liquid tube in the guide.

FIGS. 6 and 7 show states in which the supply tubes 23 and the waste liquid tube 66 are not routed in the guide 80, and FIGS. 8 and 9 show states in which the supply tubes 23 and the waste liquid tube 66 are routed in the guide 80.

As shown in FIGS. 6 and 7, the guide 80 is located at a position overlapping the liquid containers 40 in plan view. This reduces the distance between the liquid containers 40 and the maintenance device 60, and thus makes the liquid ejecting apparatus 1 compact.

More specifically, the guide 80 is located to the −Y side and −Z side of the levers 50 of the liquid containers 40. Hence, the levers 50 can be smoothly opened and closed without interfering with the guide 80.

In plan view, the guide 80 has a substantially rectangular shape with the long sides extending in the X-axis direction and the short sides extending in the Y-axis direction. The guide 80 is located above the six liquid containers 40. The guide 80 is fixed to the housing 2.

With this structure, for example, even when vibration occurs due to movement of the carriage 21, the guide 80 is not displaced and can reliably hold the supply tubes 23 and the waste liquid tube 66 in place.

The guide 80 has areas in which the respective supply tubes 23 are routed, and each area has a lane 81. The lanes 81 are divided by partition walls 82.

Supply ports 45 in the liquid containers 40, to which the supply tubes 23 are coupled, are provided below the guide 80. The lanes 81 are formed so as to guide the supply tubes 23, coupled to the supply ports 45, initially toward the +Z side and then toward the −X side. The width of the lanes 81 is substantially the same as the diameter of the supply tubes 23. In plan view, the partition walls 82 have curved surfaces, and the supply tubes 23 are routed along the lanes 81.

In the housing 2, the lane 81 corresponding to the supply tube 23 (23Y) coupled to the liquid container 40 (40Y), which is disposed on the extreme +X side among the six liquid containers 40, is the longest, and the lengths of the lanes 81 gradually decrease from the +X side toward the −X side. Because the respective supply tubes 23 are routed along the corresponding lanes 81, the supply tubes 23 do not interfere with each other, thus simplifying the routing structure of the supply tubes 23.

Furthermore, gaps 85 are provided between the lanes 81. In this embodiment, the gaps 85 are provided between the partition walls 82 and have a groove shape. The gaps 85 are provided corresponding to the positions of the supply ports 45 in the liquid containers 40. More specifically, the lanes 81 are formed substantially directly above the supply ports 45, and the gaps 85 are formed substantially directly above the areas between the adjoining supply ports 45. This structure makes routing of the supply tubes 23 from the supply ports 45 to the lanes 81 easy. By making the gaps 85 have a groove shape, the weight of the guide 80 is reduced.

Each lane 81 has tabs 84 that restrict protrusion of the supply tube 23 or the waste liquid tube 66 from the lane 81.

The tabs 84 are projections that partially cover the upper portions of the supply tubes 23 or the waste liquid tube 66 routed along the lanes 81. The tabs 84 are provided on the top surfaces of the partition walls 82. In this embodiment, the tabs 84 include: tabs 84*a* provided at first ends of the lanes 81, the first ends being closer to the supply ports 45; tabs 84*b* provided at second ends of the lanes 81; and tabs 84*c* provided between the first ends and the second ends of the lanes 81. With this structure, protrusion of the supply tubes 23 or the waste liquid tube 66 from the lanes 81 is suppressed, and the supply tubes 23 and the waste liquid tube 66 can be reliably routed. Because the tabs 84 do not entirely cover the lanes 81, routing of the supply tubes 23 and the waste liquid tube 66 along the lanes 81 is easy.

Furthermore, recesses 86 are provided in support surfaces 81*a*, which support the supply tubes 23 in the lanes 81. The support surfaces 81*a* are surfaces in areas other than the partition walls 82, in the areas constituting the lanes 81. In this embodiment, as shown in FIG. 6, the recesses 86 are provided at the −X side ends of the lanes 81 in the guide 80. With this structure, for example, even when a supply tube 23 has a length larger than a predetermined dimension, by routing the supply tube 23 so as to extend along the recess 86, fine dimension adjustments of the supply tube 23 can be easily performed. In other words, the recesses 86 serve as buffer areas for adjusting the lengths of the supply tubes 23. The number and size of the recesses 86 provided in each lane 81 can be set as appropriate.

As shown in FIG. 7, eaves 88 projecting obliquely downward are provided at the −Y side and −Z side end of the guide 80. The eaves 88 press films 48, which constitute portions of the exteriors of the liquid containers 40, downward from above. The films 48 constitute portions of the exteriors of the liquid containers 40 and are bonded to the −X side. Because the films 48 are bonded so as to protrude from the exteriors of the liquid containers 40, the portions protruding from the exteriors of the films 48 can come into contact with the carriage 21 moving in the X-axis direction. To prevent this, the eaves 88 are provided above the films 48 and between the lanes 81. In other words, the eaves 88 are provided at positions where the gaps 85 are provided. With this structure, by holding the films 48 with the eaves 88, the amount by which the films 48 protrude from the exteriors is reduced, preventing contact between the films 48 and the carriage 21.

Furthermore, as shown in FIGS. 8 and 9, in the guide 80, a supply tube 23 and the waste liquid tube 66 are routed so as to be vertically stacked. In this embodiment, from the standpoint of the routing efficiency of the supply tube 23 and the waste liquid tube 66 in the guide 80, the waste liquid tube 66 is routed above the supply tube 23. Because there is no need to increase the width of the lanes 81, the size of the guide 80 in the X-axis direction can be reduced.

As shown in FIG. 8, a space 90 in which the waste liquid tube 66 can freely move is provided between the maintenance device 60 and the guide 80. More specifically, the space 90 is provided in the area below the guide 80 in which the waste liquid tube 66 is routed. With this structure, for example, when the waste liquid tube 66 is slightly long, the excess portion of the waste liquid tube 66 can be routed to the space 90. Furthermore, a tube-bending prevention/protection member, which suppresses bending (kink) of the waste liquid tube 66, may be provided on the outer circumferential portion of the waste liquid tube 66 routed to the space 90. With this structure, even when the space 90 is narrow, bending of the waste liquid tube 66 is suppressed, allowing the waste liquid to smoothly flow.

Furthermore, in the left-right direction (X-axis direction) of the guide 80, the waste liquid tube 66 is routed to the lane 81 of the supply tube 23 that is routed at a position away from the waste liquid container 70. As shown in FIG. 8, when the supply tube 23Y is routed to the guide 80 at a position farther from the waste liquid container 70 than the other supply tubes 23M, 23C, 23GR, 23K2, and 23K1 are, the waste liquid tube 66 is routed to the lane 81 for the supply tube 23Y. With this structure, when, for example, the liquid ejecting apparatus 1 is placed in a wrong orientation such that the waste liquid container 70 is located below the liquid containers 40, the waste liquid tube 66 routed to the guide 80 can be located at a position higher than the liquid level in the liquid container 40Y. Hence, flow of the liquid from the six liquid containers 40 to the waste liquid container 70 through the liquid ejecting head 22 and the maintenance device 60 is suppressed, and leakage of the waste liquid to the outside from the waste liquid container 70 is prevented.

A portion of the waste liquid tube 66 extending between the guide 80 and the waste liquid container 70 is routed so as to be located closer to the front side (+Y side) than the introduction member 71, serving as a coupling portion coupling the waste liquid container 70 and the waste liquid tube 66, is. With this structure, when the liquid ejecting apparatus 1 is placed so as to stand on the rear side thereof, leakage of the waste liquid from the waste liquid container 70 is prevented. The tube-bending prevention/protection member for preventing bending (kink) of the waste liquid tube 66 is provided on the outer circumferential portion of the waste liquid tube 66 routed between the guide 80 and the waste liquid container 70. With this structure, even when the space between the guide 80 and the waste liquid container 70 is small, bending of the waste liquid tube 66 is suppressed, enabling smooth flow of the waste liquid.

What is claimed is:

1. A liquid ejecting apparatus having a housing constituting an exterior, the liquid ejecting apparatus comprising:

a liquid ejecting head that ejects liquid;

a liquid container that stores the liquid to be supplied to the liquid ejecting head;

a maintenance device that performs maintenance of the liquid ejecting head;

a waste liquid container that stores the liquid discharged in the maintenance device from the liquid ejecting head as waste liquid;

a supply tube coupling the liquid container and the liquid ejecting head;

a waste liquid tube coupling the maintenance device and the waste liquid container; and a guide along which the supply tube and the waste liquid tube are routed in parallel, wherein, assuming that one side of the housing is a rear side and another side facing the one side is a front side in plan view, the maintenance device is disposed closer to a rear side than the liquid container is, the liquid ejecting head is disposed at a side of the maintenance device so as to be movable in a left-right direction, which intersects a front-rear direction in which the rear side and the front side face each other, the waste liquid container is disposed closer to a front side than the liquid ejecting head is and is disposed at a side of the liquid container, and the guide is disposed in an area between the maintenance device and the front side of the liquid container.

2. The liquid ejecting apparatus according to claim 1, wherein, in plan view, the guide is disposed at a position overlapping the liquid container.

3. The liquid ejecting apparatus according to claim 1, wherein the supply tube and the waste liquid tube are routed so as to be vertically stacked in the guide.

4. The liquid ejecting apparatus according to claim 1, further comprising, between the maintenance device and the guide, a space in which the waste liquid tube is allowed to move freely.

5. The liquid ejecting apparatus according to claim 1, wherein a portion of the waste liquid tube extending between the guide and the waste liquid container is routed so as to be closer to the front side than a coupling portion is, where the waste liquid container and the waste liquid tube are coupled.

* * * * *